US006718900B2

(12) United States Patent
Carter

(10) Patent No.: US 6,718,900 B2
(45) Date of Patent: Apr. 13, 2004

(54) VARIABLE STORAGE VESSEL AND METHOD

(76) Inventor: Gregory James Carter, 10910 Auger Pl., The Woodlands, TX (US) 77380

( * ) Notice: Subject to any disclaimer, the term of this patent is extended or adjusted under 35 U.S.C. 154(b) by 0 days.

(21) Appl. No.: 10/166,200

(22) Filed: Jun. 11, 2002

(65) Prior Publication Data

US 2003/0226489 A1 Dec. 11, 2003

(51) Int. Cl.[7] ..... B65D 88/78
(52) U.S. Cl. ..... 114/257
(58) Field of Search ..... 114/256, 257, 114/230.1, 230.2, 293, 264; 405/210

(56) References Cited

U.S. PATENT DOCUMENTS

| | | | | | |
|---|---|---|---|---|---|
| 2,655,888 | A | * | 10/1953 | Alcorn | 114/256 |
| 3,146,458 | A | | 8/1964 | Estes et al. | 64/46.5 |
| 3,292,695 | A | | 12/1966 | Haeber | 166/0.5 |
| 3,435,793 | A | | 4/1969 | Shurtleff | 114/0.5 |
| 3,504,496 | A | | 4/1970 | Hnot | 61/0.5 |
| 3,540,397 | A | | 11/1970 | Burns | 114/0.5 |
| 3,552,131 | A | | 1/1971 | Mott et al. | 61/46 |
| 3,572,278 | A | | 3/1971 | Knapp et al. | 114/0.5 |
| 3,595,278 | A | * | 7/1971 | Lilly et al. | 141/1 |
| 3,599,590 | A | | 8/1971 | Rego | 114/0.5 |
| 3,643,447 | A | | 2/1972 | Pogonowski | 61/46 |
| 3,727,418 | A | | 4/1973 | Glazier | 62/45 |
| 3,798,919 | A | | 3/1974 | Hershner, Sr. | 62/45 |
| 3,837,310 | A | | 9/1974 | Toyama | 114/0.5 |
| 3,889,477 | A | | 6/1975 | Tam | 61/46.5 |
| 3,898,846 | A | | 8/1975 | McCabe | 61/46 |
| 3,943,724 | A | | 3/1976 | Banzoli et al. | 61/46.5 |
| 4,067,080 | A | | 1/1978 | Sylverst | 9/8 |
| 4,107,803 | A | * | 8/1978 | Sylverst | 441/4 |
| 4,141,377 | A | | 2/1979 | Fernandez et al. | 137/236 |
| 4,190,072 | A | | 2/1980 | Fernandez et al. | 137/236 |
| 4,195,951 | A | | 4/1980 | Finsterwalder | 408/148 |
| 4,230,422 | A | | 10/1980 | Brown et al. | 405/210 |
| 4,232,983 | A | * | 11/1980 | Cook et al. | 405/210 |
| 4,351,623 | A | | 9/1982 | Heinz et al. | 405/210 |
| 4,365,576 | A | | 12/1982 | Cook | 114/265 |
| 4,399,765 | A | | 8/1983 | Alkner et al. | 114/256 |
| 4,402,632 | A | | 9/1983 | Cook | 405/210 |
| 4,433,940 | A | | 2/1984 | Harrison | 405/210 |
| 4,506,623 | A | | 3/1985 | Roper et al. | 114/256 |
| 4,606,673 | A | | 8/1986 | Daniell | 405/210 |
| 4,645,379 | A | | 2/1987 | Grimsley et al. | 405/210 |
| 4,653,960 | A | | 3/1987 | Chun | 405/210 |
| 4,662,386 | A | | 5/1987 | Pedersen | 137/236 |
| 4,735,524 | A | | 4/1988 | Dunkers | 405/63 |
| 4,907,912 | A | | 3/1990 | Smith | 405/208 |
| 4,944,872 | A | | 7/1990 | Kantor | 210/170 |
| 5,080,783 | A | | 1/1992 | Brown | 210/170 |
| 5,083,523 | A | | 1/1992 | Osborne-Moss et al. | 114/256 |
| 5,251,571 | A | | 10/1993 | Willinsky et al. | 119/215 |
| 5,820,300 | A | | 10/1998 | Sonoda et al. | 405/188 |
| 6,010,295 | A | | 1/2000 | Sridhar | 414/38.5 |
| 6,230,645 | B1 | | 5/2001 | Chow | 114/264 |
| 6,260,501 | B1 | * | 7/2001 | Agnew | 114/257 |

FOREIGN PATENT DOCUMENTS

| | | | |
|---|---|---|---|
| FR | 1.241.664 | 12/1960 | |
| FR | 2.167.311 | 8/1973 | |
| GB | 777644 | 6/1957 | |
| NL | 8104712 | 5/1983 | 1/20 |
| WO | 86/07577 | 12/1986 | |
| WO | 87/06212 | 10/1987 | |

* cited by examiner

*Primary Examiner*—Stephen Avila
(74) *Attorney, Agent, or Firm*—Baker & Hostetler, LLP

(57) ABSTRACT

A method and apparatus for storing bulk materials in a marine environment is provided. The apparatus includes a flexible pod configured for fluid communication to a host vessel. The pod stores materials under water.

37 Claims, 7 Drawing Sheets

VARIABLE STORAGE VESSEL AND METHOD

FIELD OF THE INVENTION

The present invention relates generally to storing materials in a marine environment. More particularly, the present invention relates to storing materials underwater.

BACKGROUND OF THE INVENTION

Storing large amounts of fluids and dry bulk material on offshore floating and fixed structures to support day-to-day operations is becoming increasingly more challenging. Large offshore operations such as drilling for oil, natural gas, or other offshore operations require large amounts of bulk materials and various chemicals to perform tasks associated with these offshore operations. Bulk volumes, otherwise termed in this document as variable loads or bulk materials, may pertain to volumes of material, wet or dry, used by a host in a body of water for its day-to-day operations. Examples of well bulk materials include potable water, drilling water, drilling muds, well completion fluids, sewage, waste water, chemicals, diesel fuel, and the like. Dry bulk materials can be products such as barite, cement, drill cuttings and viscosifiers. The bulk materials include stored volumes of a product produced by the host such as oil, or other produced products. As those operations are being performed in deeper and deeper water, as well as deeper well depth, cost effective means to assist in supporting these large volumes of materials are becoming more and more important.

Storing large bulk items requires support vessels or structures to support the weight of the materials. Currently, supporting heavy volumes of materials require either floating vessel hulls to support the weight of the bulk materials or large fixed structures based at the bottom or floor of body of water. These support vessels or structures add greater cost to exploration and production projects potentially stifling the viability of further deep well or deep water exploration. The increased equipment for larger bulk volumes extends into other industries such as fishing, shipping, geoscience surveying, aqua farming and potentially offshore habitats.

Storing large amounts of bulk material on board a vessel requires a large amount of vessel hull and associated support structure dedicated to the support of the bulk materials. Reducing the amount materials supported by a vessel hull reduces the amount of vessel hull required to support not only the bulk materials, but the associated support structure also. Vessels can only support limited amounts of weight. In order to store more weight, either more vessels or larger vessels are required. Either option dramatically increases costs. Thus, reducing the amount of bulk materials supported by a vessel hull will result in a large savings in investment of vessel hull dedicated to supporting the materials.

SUMMARY OF THE INVENTION

It is therefore a feature and advantage of the present invention to provide a cost effective method of storing large volumes of heavy bulk materials in offshore and other underwater applications.

The above and other features and advantages are achieved through the use of a novel storage system as herein disclosed. In accordance with one embodiment of the present invention, a submersible for storing bulk materials is provided. The submersible includes: a substantially watertight resilient container for storing the materials under water, and a mooring line slidablely engaged with the submersible, so the container positions itself along the mooring line in response to environmental conditions and a buoyancy associated with the container.

In accordance with another embodiment of the present invention, a system for storing materials under water is provided. The system includes: a host vessel, a pod for storing the material under water attached to the host vessel by at least one hose and the hose configured to transfer the material between the pod and the host, a buoy attached to the pod for marking a location of the pod, a mooring line attached to the pod for limiting movement of the pod, wherein the pod is configured to store the materials in a watertight manner.

In accordance with another embodiment of the present invention, a storage vessel for storing a material underwater is provided. The vessel includes: a flexible means for storing in a substantially watertight configuration the material supported by a buoyancy force created by displacing water, a mooring means connected for mooring the flexible storing means, a communication means for providing fluid communication between the storing means and a host vessel; and means for moving the material between the storing means and the host vessel via the communication means.

In accordance with another embodiment of the present invention, a method of storing materials under water is provided. The method includes: deploying a storage pod under water, moving the materials between the pod and the host vessel while the pod is under water, mooring the storage pod to at least one of a buoy and host vessel via a mooring line, and permitting the storage pod to travel along the mooring line.

In accordance with another embodiment of the present invention, a method of storing materials under water is provided. The method includes: attaching a storage pod to a host vessel, deploying a storage pod under water, providing fluid communication between the host vessel and an interior of the storage pod, and supporting the pod entirely by its own buoyancy.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

An embodiment of the present invention includes an apparatus and method for storing large volumes of heavy bulk materials below the surface of the ocean or another body of water. The storage vessel itself may be designed to be flexible and manageable in bodies of water and may be designed to work with the environmental forces of the bodies of water such as currents and reactions from waves.

Figure 1:
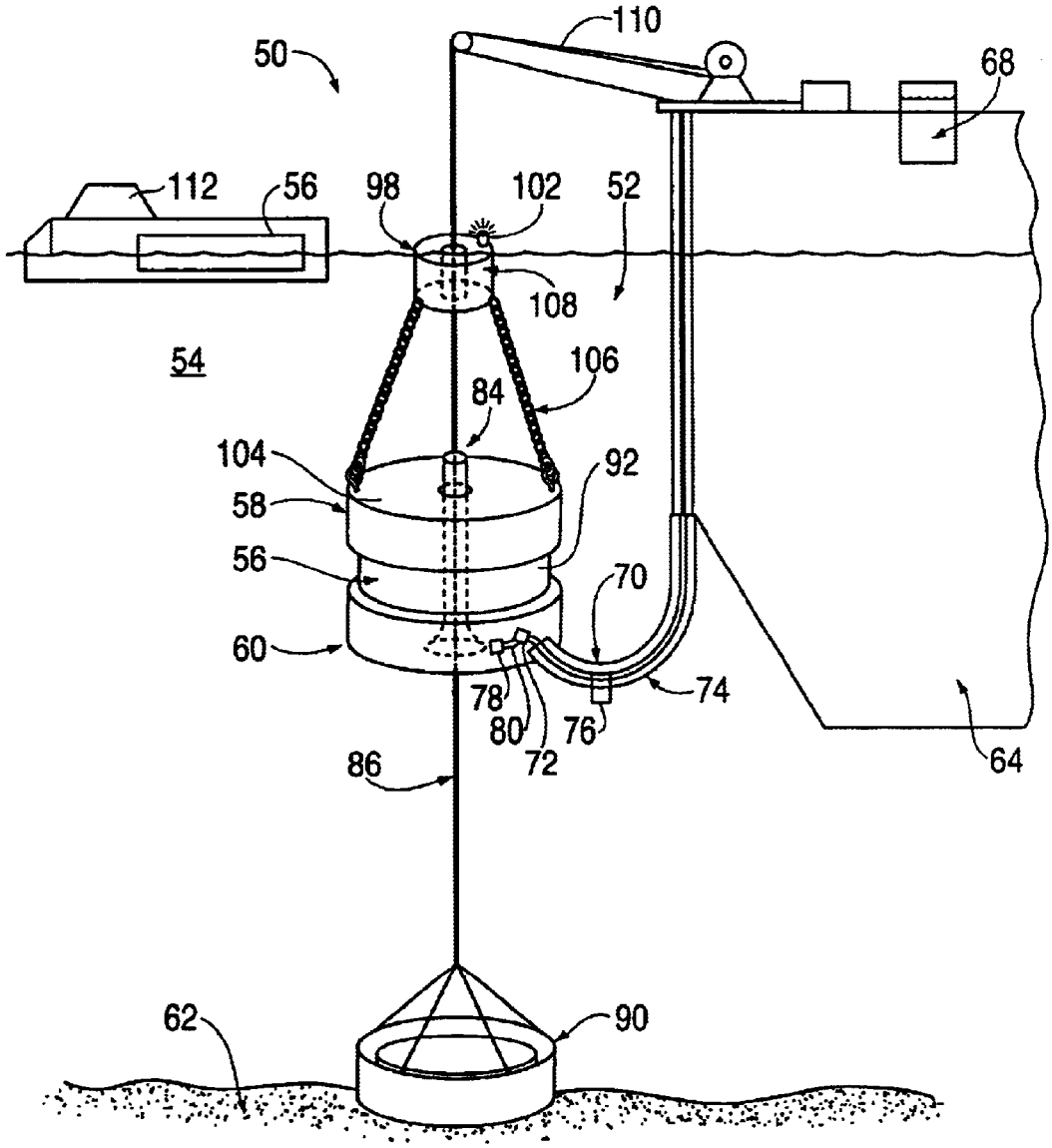
FIG. 1 is a drawing of one embodiment of the invention including a storage pod attached to a host vessel.

Referring now to the figures where like reference numerals indicate like elements, FIG. 1 illustrates an exemplary embodiment of a system 50 having a storage pod 52. The pod 52 is connected via a mooring line 86 to a host 64. The host 64 may be a floating vessel or a bottom fixed structure with an exposed surface above the water. Floating vessels such as ships, boats, floating drilling and production platforms like SPARs, TLPs and DDCVs, floating storage and production vessels, semi-submersables, drill ships and barges may serve as host vessels 64. Bottom fixed hosts may be secured to the bottom of a body of water. Examples of these type of hosts 64 include drilling and production platforms, jackups, artificial islands, docks and fixed inhabitants.

The host 64 is sitting in a body of water 54. The body of water 54 can be fresh or saline. The body of water 54 may include oceans, seas, gulfs, lakes, bayous, bays, rivers, streams, ponds or any other naturally occurring or artificial bodies of water.

The bulk materials 66 are stored in the pod 52. The pod 52 is associated with the mooring line 86. The mooring line 86 may be anchored to the bottom of the body of water by an anchor 90. This anchor 90 may include concrete, chain or other suitable materials for an anchor.

Figure 3:
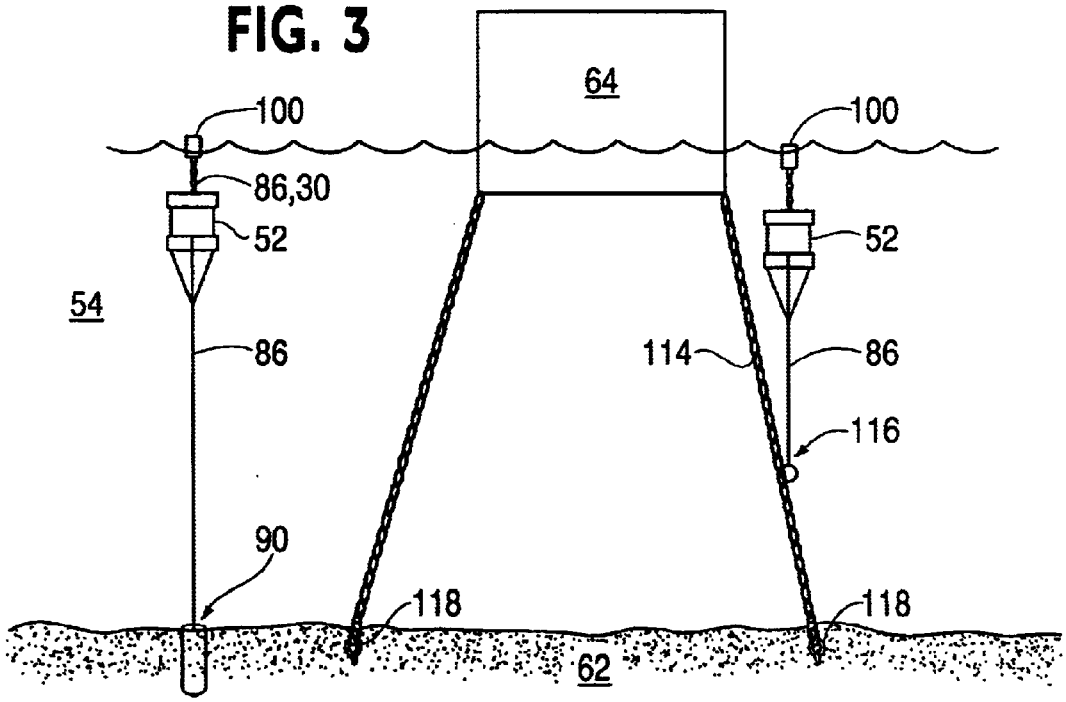
FIG. 3 illustrates an embodiment of the invention configured for use in a deep water application.

Some optional embodiments of the invention may include attaching the mooring line 86 to a buoy 100 as shown in FIG. 3 instead of to a host 64.

The submerged storage vessel pod 52 may take on various shapes depending on the weight and volume of the materials stored. As previously mentioned the stored materials 66 may include, but are not limited to, drill water, potable water, drilling muds, completion fluids, diesel fuel, sewage, waste water, preloaded fluids, chemicals, oil, or other bulky items.

If the specific gravity of the materials 66 stored in the pod 52 is greater than the specific gravity of the surrounding water 54, a floatation support base 60 and cap 58 may be used to float the heavier material load. If the specific gravity of the materials 66 stored in the vessel is lighter than the specific gravity in the body of water it is stored in, a weighted cap 58 or weighted base 60 may be used to keep the lighter stored material from floating to the surface. Thus, the load and cap 58 and base 60 may be balanced to achieve a decided amount of buoyancy.

In order to move materials to and from the pod 52, a hose 30 is used for fluid communication between the pod 52 and host 64. Occasionally, the pod 52 and host 64 may be separated from each other as shown in FIG. 3. A connecting apparatus 130 may be provided for attaching a hose 30 to the pod 52 and host 64.

Bulk materials 66, whether in fluid or dry form, may be pumped from the host 64 into the elastic pod 52 for storage in the cell 56 portion of the pod 52. The cell 56 is made of a flexible, resilient material such as rubber, rubber coated fabric, a polymer or other similar type material. The cell 56 may be configured to expand or contract in accordance with the amount of fluids or the bulk material 66 that is stored within it.

In some embodiments the elastic storage cell 56 may be made of a self healing material similar to the type of material used in military aircraft fuel tanks and/or incorporate a leak detection mesh 92 placed in between an inner and outer wall. The leak detection mesh 92 may be operatively connected to a sensor on top of the retrieval buoy 100 or the adjacent host 64. A warning device 102 may be used on the buoy as shown in FIG. 1 or on the host (not shown) will alert those nearby that there is a breach in the elastic storage cell 56. This type system may be used depending on the material 66 stored in the pod 52.

In some embodiments, the material 66 is pumped from the adjacent host 64 by a motive fluid 68. A jet booster elbow 72 boosts, the motive fluid which will be described further below. The flow from the booster elbow 72 boosts, the fluid from the elastic cell 56 to the adjacent host 64 through a larger diameter hose 74. A back pressure valve 76 may keep the motive fluid 68 from back flowing into the elastic cell 56. A suction strainer 78 maybe attached to the suction hose 80 in the storage cell 56. The motive fluid 68 may be the same fluid as stored in the elastic storage cell 56. The hose 70 may be used in the transfer for the motive fluid 68 is smaller in diameter than the take on hose 74. Other embodiments (not shown) may simply use mechanical or electric pumps in the cell 56 or within the return hose 74 or on the host 64.

The storage vessel 52 may hold various volumes and may be sized according to the user's need. In some embodiments, the cell 56 may be collapsible such that the cell 56 can fold into the flotation base 60 or the cap 68. Several configurations of the cell 56 may be used in order to make this folding possible. For example, the cell 56 may take on an accordion shaped configuration such as that illustrated in FIG. 11. Other shapes may also be used. In embodiments having a cap 58 and a base 60, the cap 58 and the base 60 separate and the cell 56 expands to fill a void created between separating the cap 58 and the base 60. Optionally, when collapsed, the cell 56 may be contained within the base and/or cap. The base 60 and the cap 58 may protect the elastic cell 56 from damage when shipping. Thus, the base 60 and the cap 58 may provide a semi-rigid container for protecting the cell 56 in and out of the water.

FIG. 1 shows a collapsed cell 57 on board a tending vessel 112 where the base 60 and cap 58 provide a semi-rigid container for protecting the cell 56.

A protective sliding sleeve 84 may be mounted to the base 60 or the cap 58 to protect the cell 56 from the mooring line 86. The sleeve 84 may run through the center of the inner storage cell 56 and slide through the cap 58 or the base 60. The protective sliding sleeve 84 may permit the pod 52 to slide up and down the mooring line 86 without wearing or rubbing the flexible cell 56.

The pod 52 can move up and down in accordance with waves or currents in the ocean. The pod 52 may be generally configured to move to a certain depth where it becomes neutrally buoyant. That depth can be determined by the individual needs of the specific application where the pod 52 is deployed.

When the elastic storage cell 56 is emptied and collapsed and stored in the base 60 and cap 58 it may be picked up by a sliding sling and put onboard a ship or adjacent host 64. The mooring line 86 and the anchor 90 may be retrieved and transported as needed. The mooring line may be secured by a crane or jib 110 attached to the host 64.

Several concepts are incorporated into the design of the storage pod 52 to ensure there is not threat from it to the host vessel 64. One solution is to locate the pods 52 at a depth such as below the draft of the host vessel 64. Some embodiments of the invention may include a soft flexible material 104 surrounding the pod 52 to prevent damage to the pod 52 and nearby structures such as vessels or host vessels 64 in the water. A retrieval line may be attached to the top of the storage vessel 64 with a buoy marker floating on top of the water 54. A retrieval buoy 100 can be marked with a beacon 108.

To increase storage capacity, multiple storage vessels 52 can be tied together in parallel and other configurations to allow their contents to be shared.

Figure 2:
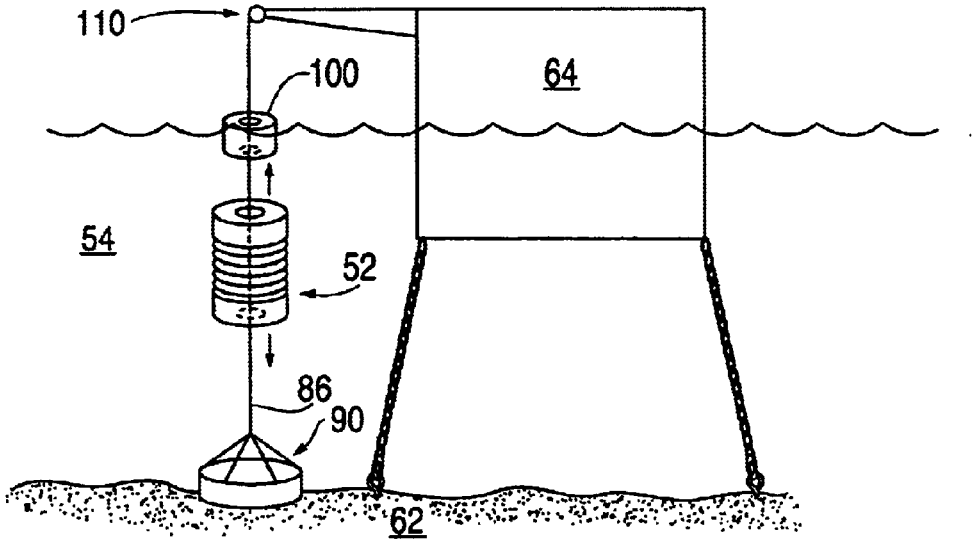
FIG. 2 illustrates an embodiment of the invention configured for use in a shallow water application.

As shown in FIGS. 1 and 2 shallow water operations may include a host 64 with a mooring line 86 anchored to the bottom 62 with an anchor 90. The pod 52 may be placed along the mooring line in the water 54, and a buoy 100 may be used to mark the location of the pod. The pod 52 may be configured to move up and down the mooring line 86 according to currents and waves and to find its naturally buoyant position. The mooring line 86 may be secured to the host by a crane or jib 110.

FIG. 3 illustrates another exemplary configuration for the pod 52. This configuration may be used in deep water applications. The host vessel 64 may be anchored to the bottom via anchor chain 114 and anchors 118. The mooring line 86 may be secured either to the anchor chain 114 of the host vessel 64 and connected by a connection 116, or it may be anchored to the bottom 62 with an anchor 90. Optionally, the mooring line 86 may not be attached to the host 64 but to a buoy 100. A hose 30 may also be connected to the buoy 100, or directly to a host 64.

Figure 4:
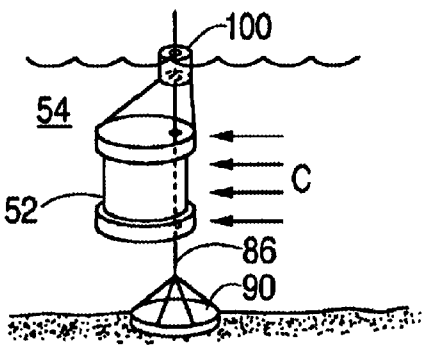
FIG. 4 illustrates an embodiment of the invention configured for use an application with a constant current.

FIG. 4 illustrates an alternate configuration of the pod 52 where the pod 52 is subjected to a steady current as denoted by arrows labeled "C". This may be applicable in applications involving rivers oceans or other places where a current is often present. The pod 52 may be configured in a teardrop configuration along the mooring line 86. The teardrop configuration may have a rounded head portion and an elongated tail portion. The pod 52 is able to move freely along the mooring line 86 to reduce loads to the host 64 and also self configure itself in a most efficient matter against a current.

Figure 5:
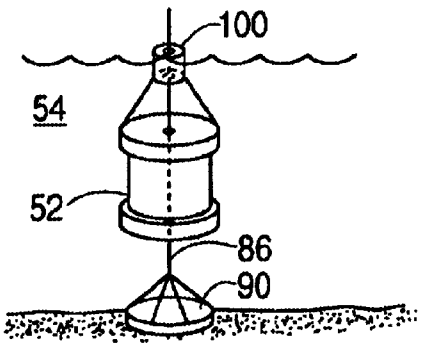
FIG. 5 illustrates an embodiment of the invention configured for use when currents and waves of actions are not particularly adverse.
Figure 6:
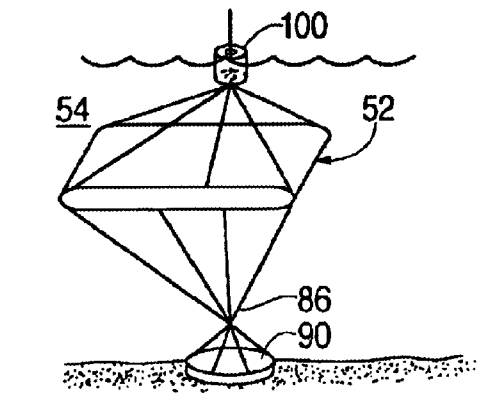
FIG. 6 illustrates an embodiment of the invention with the pod configured in a pillow shape.
Figure 7:
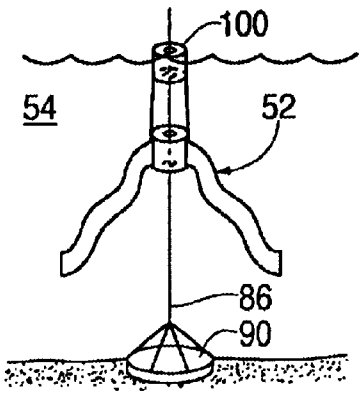
FIG. 7 illustrates an embodiment of the invention with the pod configured in a tubular shape.
Figure 8:
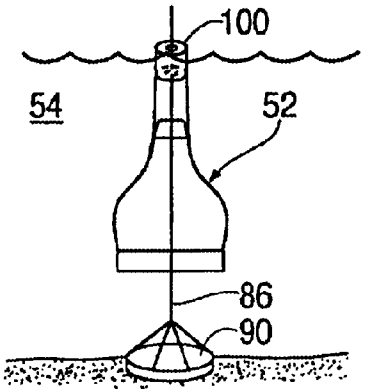
FIG. 8 illustrates an embodiment of the invention with the pod configured in a pear shape.

FIG. 5 shows a pod 52 in a more conventional environment where very large current forces are not a concern. In this case, the pod 52 is in a cylindrical shape. Alternative embodiments of the invention include pods in a pillar shape illustrated in FIG. 6, a tubular shape illustrated in FIG. 7 and pear shaped illustrated in FIG. 8. The various shapes conform to the water body 54 forces and specific gravity of the material 66 stored in the cell 56.

Figure 9:
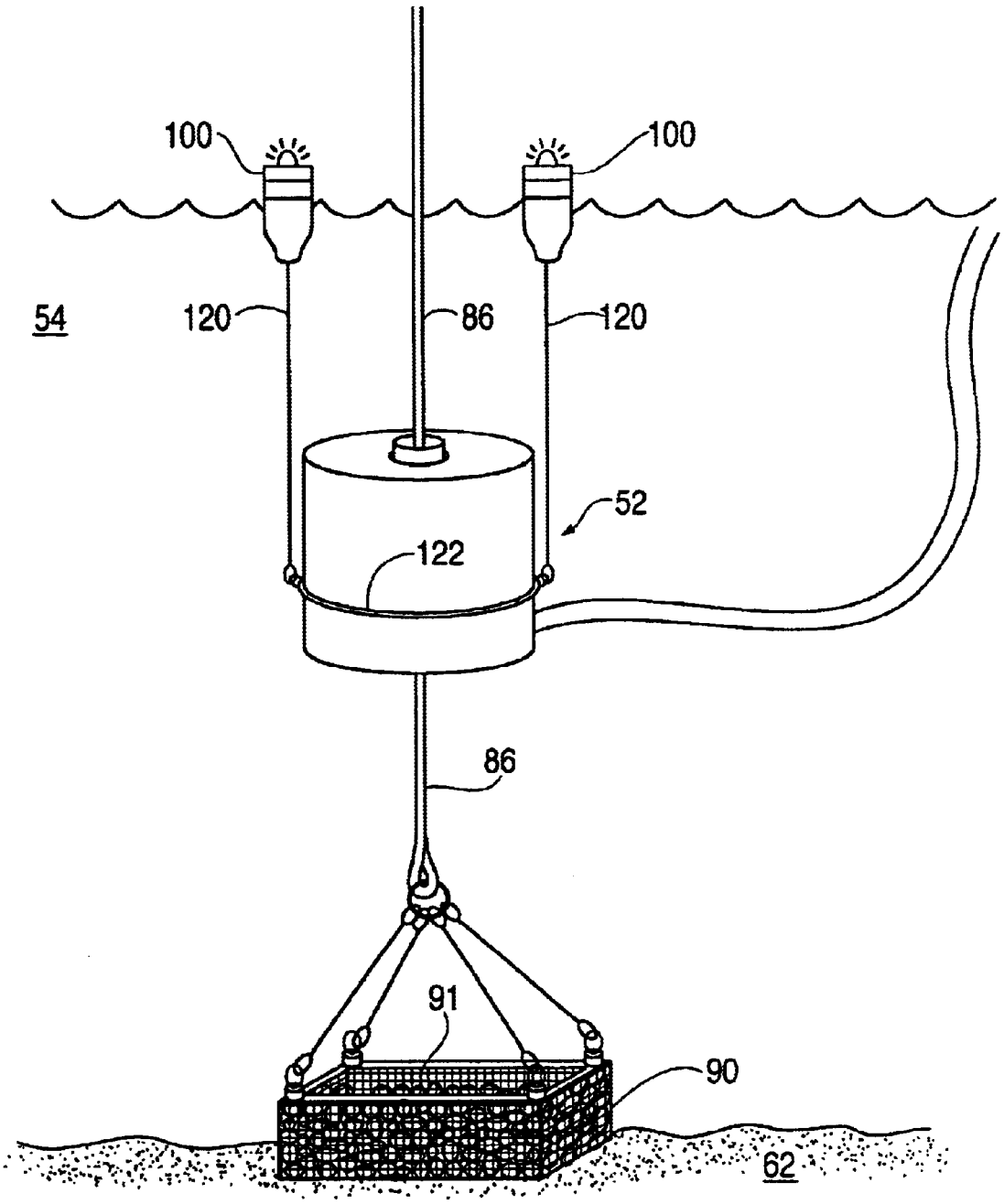
FIG. 9 illustrates an embodiment of the invention including two buoys.

Another optional embodiment of the invention is illustrated in FIG. 9. The pod in FIG. 9 is partially supported by buoys 100. The buoys 100 are attached not to the anchor line 86 but rather to a separate support line 120. The support line 120 is attached to the pod 52 via a strap 122. Optionally, anchor 90 may be comprised of a basket filled with chain 91 as shown in FIG. 9.

Figure 10:
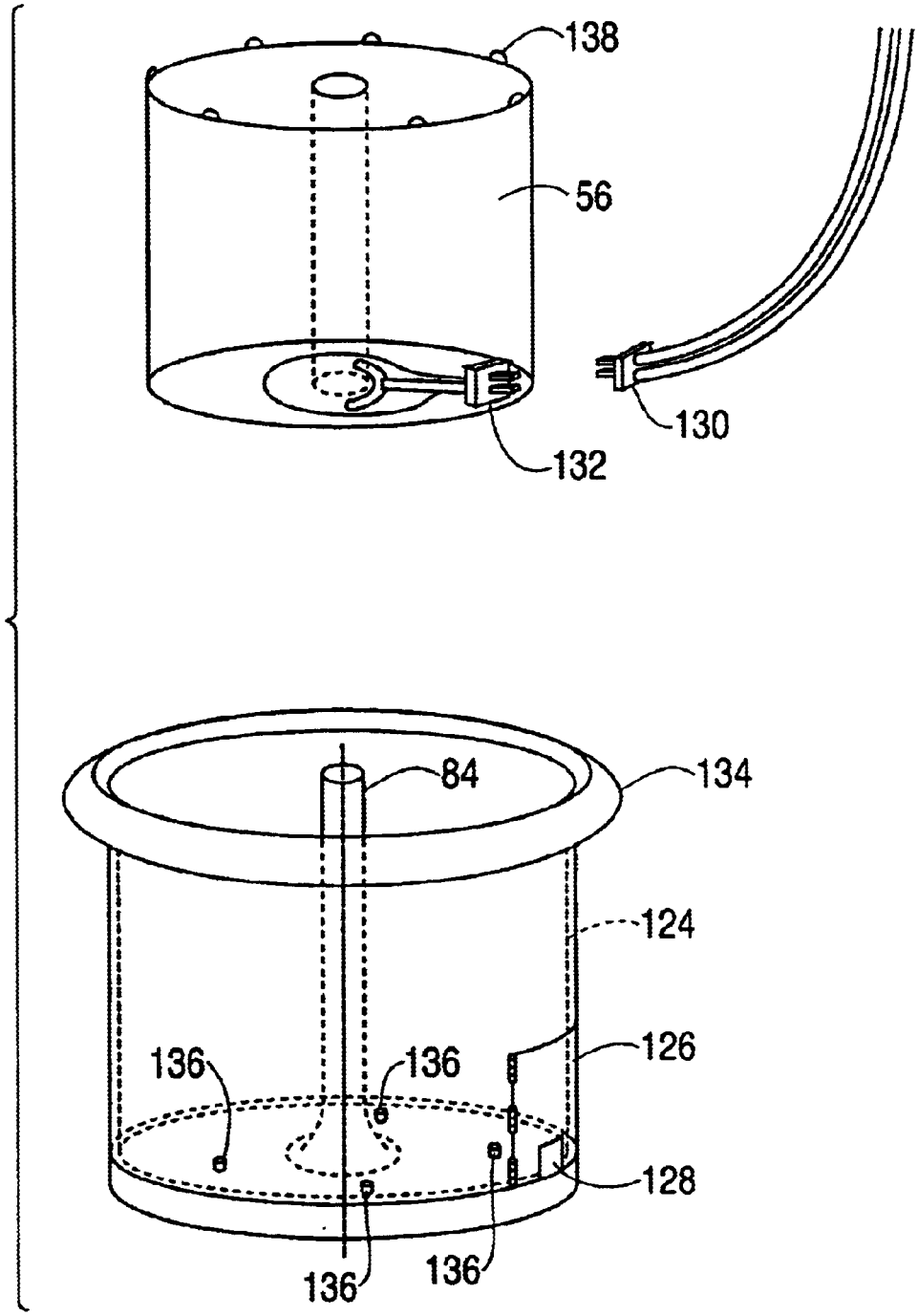
FIG. 10 is an exploded view of an alternate embodiment of the invention with the pod is encased inside a protective sleeve.

Another optional embodiment of the invention as shown in FIG. 10 includes the pod 52 configured as a two-piece construction. A flexible cell 56 fits inside a more rigid and protective shell 124. The shell 124 may include a protective sleeve 84 located down the center of the cell 56. The fitting pins 136 may communicate to attach the shell 124 to the cell 56. The hose attachments to the cell 56 may be accomplished through a door 126 and a connector in the cell 56. In cases where the material 66 being stored is lighter than the surrounding water, the shell 124 may be turned upside down to act as a weight and keep the cell 56 from floating to the top of the surface. In applications where the material stored in the pod 52 is heavier than the surrounding water, than ring 134 may be configured as a flotation ring and keep the pod from sinking to the bottom 62 of the body of water 54. The hose connector 130 connects into the pod receptical 132 and may be accessed generally through a larger door 126. The opening 128 may permit the hose connection 130 to connect to pod receptical 132 while the door 126 is shut.

Figure 11:
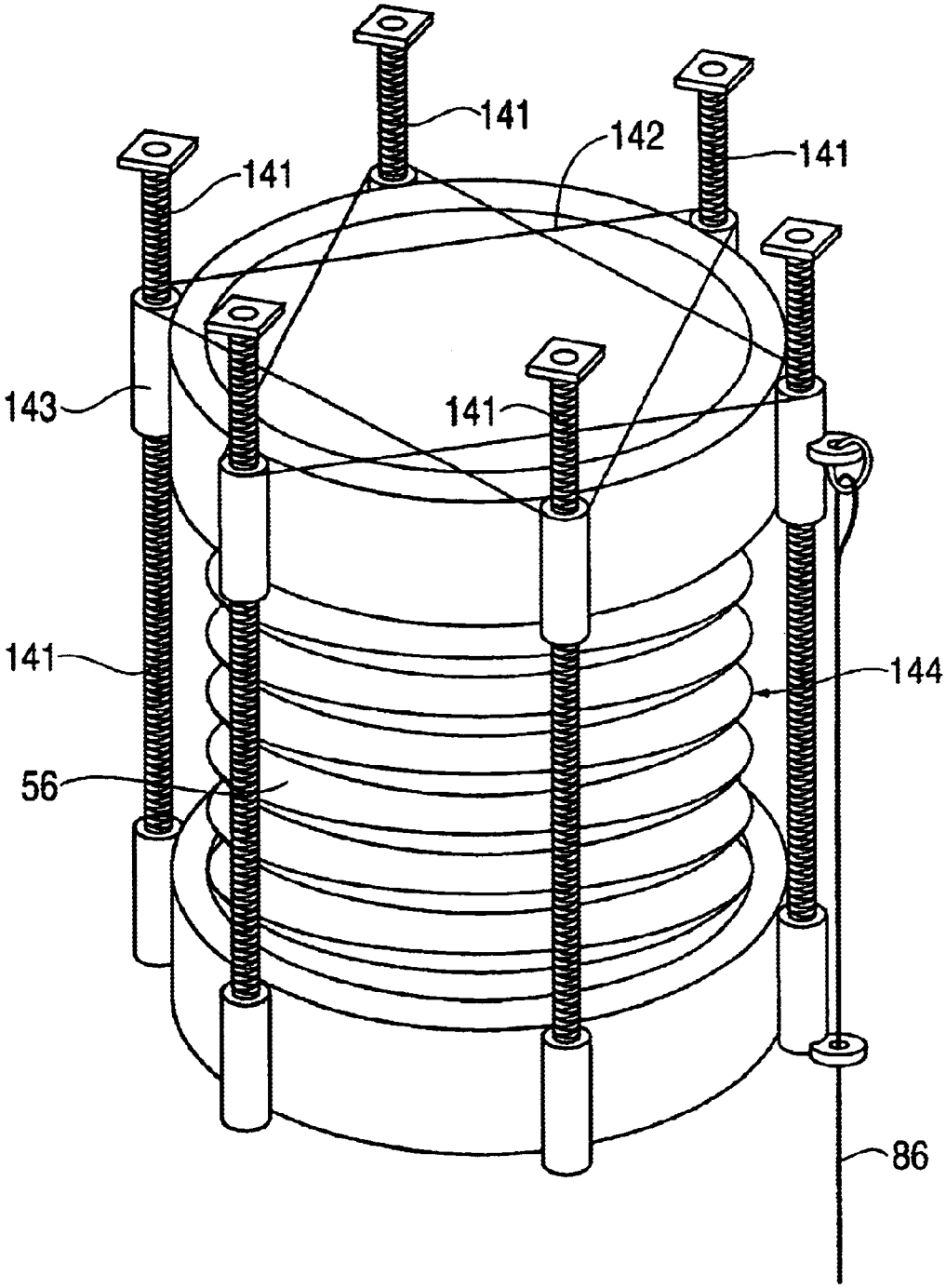
FIG. 11 illustrates another embodiment of the invention with the pod incased by a frame work.

Another embodiment of the invention is shown in FIG. 11. In FIG. 11 the flexible cell 56 is housed in a framework 140. The framework may be attached at either top or bottom of the cell 56 through a lattice work or support frame 142. The mooring line 86 may be attached by the side as illustrated in FIG. 11 or in the middle of the cell 56 as shown in the other figures and include a sleeve 86.

In some embodiments where an exterior frame 140 is used, the exterior frame 140 may include poles or columns 141 in an array around the cell 56. Support struts 142 may be attached to the columns 141 either above the cell 56 as shown in FIG. 11 or below the cell 56. The support struts 142 may be attached to the columns 141 via sliding joints 143. The sliding joints 143 may permit the support struts 142 to slide along the columns 141 as the cell 56 expands and contracts as material is loaded and off loaded to and from the cell 56. Optionally, the cell 56 may have an accordion like construction. Thus, the pod 52 with an external frame 140 may be configured to fold to a folded position.

Figure 12:
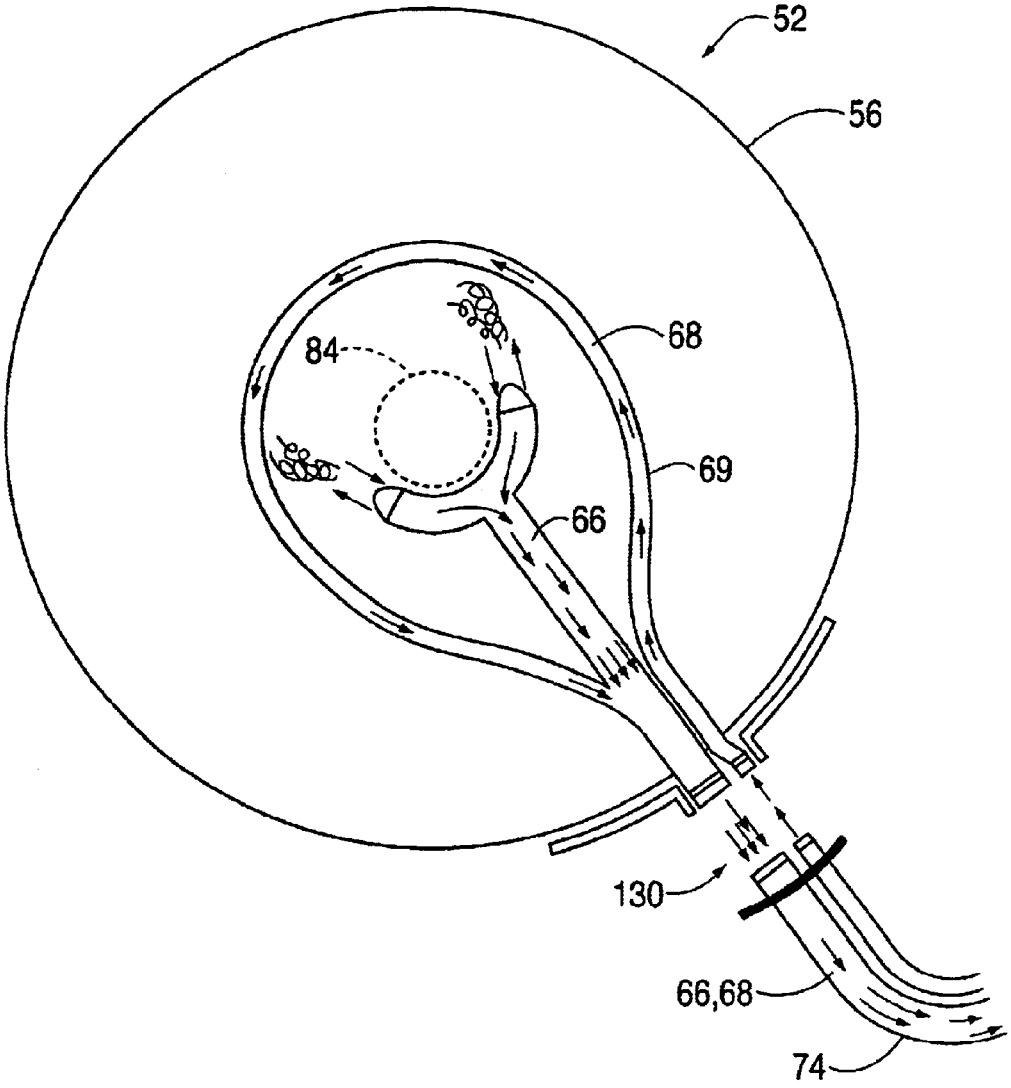
FIG. 12 illustrates an optional aspect to the invention showing how a motive fluid system is configured to extract material from the storage pod.

The material 66 may be deposited within the pod 52 and withdrawn from the pod 52 in a variety of ways. The material 66 may be pumped in and out of the pod 52 via the hose 70. One optional embodiment of the current invention involves using a motive fluid 68 for drawing the material 66 out of the pod 52. FIG. 12 illustrates one exemplary embodiment where the pod 52 is configured to have a motive fluid 68 draw the material 66 out of the pod 52. Large diameter hose 74 is connected to the pod 52 via the hose connection 130. The pod 52 is filled by materials 66 by pumping the material through the large diameter hose 74 into the pod 52. The pump may be located on the host 64 or any other place according to the specific needs of a particular application.

For drawing the material 66 out of the pod 52 and back onto the host 64 or any other place desired such as into any other pod 52 or onto an attending vessel, a motive fluid 68 may be used. The motive fluid 68 may be pumped at relatively high rate through a smaller diameter hose 69 and brought back through into the large diameter hose 74. A suction pressure is generated as the motive fluid 68 enters the large diameter hose 74 and is pumped back up toward the host 64. This suction draws material 66 from the pod 52 into large diameter hose 74 thus permitting the material 66 to be removed from the pod 52 to the place of deposit. As shown in FIG. 12, the motive fluid hose 69 may be configured to extend in a loop around the protective sleeve 84. The large diameter hose 74 may be configured to branch around in two ends around the protective sleeve 84 and be open to the interior of the pod 52. The large diameter hose 74 may be used to both remove and deposit materials out of and into the pod 52 depending on which way the materials are flowing through the hose 74 as shown by the arrows in FIG. 12.

The arrows in FIG. 12 illustrate the direction of the motive fluid 68 and the direction of the material 66 when the device is operated to draw material 66 from the interior of the pod 52. The arrows within the small diameter hose 69 show the path of the motive fluid 68 and the arrows in the large diameter hose 74 show the material 66 being drawn from the interior of the pod 52 up to the large diameter hose 74 meeting with the motive fluid 68 and the material 66 together are brought through the large diameter hose 74. In many optional embodiments of the invention the motive fluid 68 may actually be the same fluid or material 66 that is being stored within the pod 52, thus there is no corruption of material when the motive fluid 68 and the material 66 are brought together and drawn up through the large diameter hose 74.

The type of configuration involving a motive fluid 68 as illustrated in FIG. 12 includes several benefits among these may be that the pumps or power sources used to transfer the motive fluid 68 and/or materials 66 both in and out of the pod may be located on the host vessel 64 or an attending vessel and may not necessarily be located underwater. Locating the pumps or power sources above water provides certain advantages including ease of access for maintenance and also increased reliability as they need not be submerged and subject to the harsh conditions of other water environment.

While most of the figures illustrate single pod 52 configurations, it is anticipated that the capacity may be increased by using several pods 52 together. Multiple pods 52 may be configured to be in communication with each other so material 66 can be transferred between pods without necessarily needing to be transferred to the host vessel 64 first, or they may all be in communication with the host 64, or both.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A submersible for storing bulk materials comprising:

a substantially watertight resilient container for storing the materials under water and;

a flexible mooring line slidablely engaged with the container, so the container positions itself along the mooring line in response to environmental conditions and a buoyancy associated with the container.

2. The submersible of claim 1, further comprising a cap mounted on top of the container and a base mounted under the container.

3. A submersible for storing bulk materials comprising:

a substantially watertight resilient container for storing the materials under water and;

a mooring line slideably engaged with the container, so the container positions itself along the mooring line in response to environmental conditions and a buoyancy associated with the container;

a cap mounted on top of the container; and a base mounted under the container wherein the container is configured to fold up and be substantially contained within at least one of the cap and base.

4. The submersible of claim 2, wherein at least one of the cap and base provide flotation to the submersible.

5. The submersible of claim 2, wherein at least one of the cap and base provide negative bouncy to the submersible.

6. The submersible of claim 1, further comprising a protective shell configured to fit over the container.

7. A submersible for storing bulk materials comprising:

a substantially watertight resilient container for storing the materials under water; and a mooring line slideably engaged with the container, so the container positions itself along the mooring line in response to environmental conditions and a buoyancy associated with the container; and a protective shell configured to fit over the container, wherein the protective shell includes a tubular portion configured to surround a portion of the mooring line and protect the container from wear from sliding along the mooring line.

8. A submersible for storing bulk materials comprising:

a substantially watertight resilient container for storing the materials under water;

a mooring line slideably engaged with the container, so the container positions itself along the mooring line in response to environmental conditions and a buoyancy associated with the container; and a cage comprising long members attached in a framework configuration, and wherein the container includes a flexible bag disposed within and supported by the cage.

9. The submersible of claim 8, wherein the cage is configured to collapse to a folded position and the bag is configured to fold to a folded position.

10. The submersible of claim 1, wherein the mooring line is anchored to at least one of a bottom of a body of water and a host vessel.

11. The submersible of claim 10, further comprising an anchor comprising at least one of concrete and chain.

12. The submersible of claim 1, wherein the submersible is connected to a host vessel by at least one of a hose and the mooring line.

13. The submersible of claim 1, wherein the container is configured to permit the material to be loaded and offloaded via a hose.

14. A submersible for storing bulk materials comprising:

a substantially watertight resilient container for storing the materials under water and;

a mooring line slideably engaged with the container, so the container positions itself along the mooring line in response to environmental conditions and a buoyancy associated with the container, wherein a motive fluid is pumped in the hose in a configuration to offload the material and the motive fluid creates suction pressure used to offload the material.

15. The submersible of claim 14, wherein the motive fluid is substantially the same as the material.

16. The submersible of claim 1, wherein the material is at least one of fresh water, potable water, mud, well completion fluids, diesel fuel, sewage, waste water, oil, drilling mud, and drilling cuttings.

17. The submersible of claim 1, wherein a resilient material is mounted on an exterior portion of the submersible for providing protection to at least one of the submersible and other vessels in event of a collision.

18. The submersible of claim 1, further comprising a buoy attached to the submersible via a line, and, wherein the buoy provides at least one of flotation for the submersible and a marker to the location of the submersible.

19. The submersible of claim 1, further comprising at least one of hooks and loops mounted on the submersible configured to facilitate at least one of hoisting, deploying, and recovering the submersible.

20. The submersible of claim 1, wherein the submersible is supported entirely by its own buoyancy.

21. The submersible of claim 1, wherein the container is substantially annular in shape, and the mooring line passes through a center of the annular shape.

22. The submersible of claim 21, further comprising a protective sleeve positioned in the center of the annular shape wherein the mooring line passes through the protective sleeve and wherein the protective sleeve shields the container from wear from the mooring line.

23. The submersible of claim 1, wherein the container collapses to a compact position.

24. The submersible of claim 1, wherein the container includes is at least one of rubber, rubber coated fabric, and a polymer.

25. The submersible of claim 1, wherein the container is made of a self healing material, wherein minor punctures in the container will close.

26. The submersible of claim 1, wherein the container is fitted with a leak detecting sensor, wherein when the sensor detects a leak for the container of at least one of water entering the container and material leaking out of the container the sensor will send a signal to an alarm device.

27. A system for storing materials under water comprising:

a host vessel;

a pod configured to store the materials in a watertight manner under water attached to the host vessel by at least one hose configured to transfer the material between the pod and the host;

a buoy attached to the pod for marking a location of the pod; and a flexible mooring line attached to the pod for limiting movement of the pod along the length of the mooring line.

28. The system of claim 27, further comprising a plurality of pods wherein the pods are connected to the host to provide fluid communication between the pods and the host.

29. The system of claim 27, further comprising a plurality of pods wherein the pods are connected to each other to provide fluid communication between the pods.

30. The system of claim 27, wherein the pod is configured to move along the mooring line in response to forces acting on the pod cased by at least one of gravity, waves, and currents.

31. The system of claim 27, wherein the pod is supported by a line attached to the buoy.

32. The system of claim 27, wherein the pod is deployed below the waterline of the host vessel.

33. The system of claim 27, wherein the pod is deployed at least twenty feet below a surface associated with the water.

34. A storage vessel for storing a material underwater comprising:

a flexible means for storing in a substantially watertight configuration the material supported by a buoyancy force created by displacing water;

a flexible mooring means for mooring the flexible storing means;

a communication means for providing fluid communication between the storing means and a host vessel; and means for moving the material between the storage vessel and the host vessel via the communication means wherein the mooring means is slideably connected to the storage vessel.

35. A method of storing materials under water comprising:

deploying a storage pod under water;

moving the materials between the pod and the host vessel while the pod is under water;

mooring the storage pod to at least one of a buoy and host vessel via a flexible mooring line; and limiting travel of the storage pod along the mooring line.

36. A method of storing materials under water comprising:

attaching a storage pod to a host vessel;

deploying storage pod under water;

providing fluid communication between the host vessel and an interior of the storage pod;

supporting the elevation of the pod entirely by its own buoyancy; and limiting travel of the storage pod along a flexible mooring line.

37. A method of removing materials from a host vessel comprising:

providing fluid communication between the host vessel and an interior of a storage pod;

deploying the storage pod under water;

removing material from the host vessel and depositing the material into the storage pod; and limiting travel of the storage pod along a flexible mooring line.

* * * * *